US005725389A

United States Patent [19]

Scheer

[11] Patent Number: 5,725,389

[45] Date of Patent: Mar. 10, 1998

[54] EDGE CARD CONNECTOR

[75] Inventor: Dennis Keith Scheer, Downers Grove, Ill.

[73] Assignee: Molex Incorporated, Lisle, Ill.

[21] Appl. No.: 555,437

[22] Filed: Nov. 9, 1995

[51] Int. Cl.[6] ..... H01R 13/62

[52] U.S. Cl. ..... 439/328; 439/636

[58] Field of Search ..... 439/59, 62, 630–637, 439/326–328, 259, 260

[56] References Cited

U.S. PATENT DOCUMENTS

| | | | |
|---|---|---|---|
| 4,990,107 | 2/1991 | Fortuna | 439/637 |
| 5,203,714 | 4/1993 | Tuan | 439/326 |
| 5,203,725 | 4/1993 | Brunker et al. | 439/636 |
| 5,340,328 | 8/1994 | Lee | 439/326 |
| 5,514,002 | 5/1996 | Cheng et al. | 439/326 |
| 5,525,071 | 6/1996 | Obara et al. | 439/326 |

FOREIGN PATENT DOCUMENTS

| | | | |
|---|---|---|---|
| WO 96/19848 | 6/1996 | WIPO | H01R 13/62 |

*Primary Examiner*—Hien Vu

*Attorney, Agent, or Firm*—Charles S. Cohen

[57] ABSTRACT

An edge connector is provided for a printed circuit board having a mating edge and a plurality of contact pads adjacent the edge. The connector includes an elongated dielectric housing having a board-receiving slot for receiving the mating edge of the printed circuit board. A plurality of spring contact elements are mounted in the housing along at least one side of the slot. The spring contact elements have first spring contact portions extending into the slot for contacting respective ones of the contact pads on the printed circuit board. A surface of the housing at the one side of the slot defines a datum plane beyond which the spring contact portion of at least one of the spring contact elements extends into the slot. Some of the spring contact elements include second spring contact portions formed in a unique arcuate configuration for biasing the printed circuit board against the surface, thereby deflecting the first spring contact portions a predetermined amount. Identical interchangeable board latches are mounted at opposite ends of the housing and include board locks for lockingly engaging opposite sides of the printed circuit board when inserted into the board-receiving slot.

12 Claims, 5 Drawing Sheets

EDGE CARD CONNECTOR

FIELD OF THE INVENTION

This invention generally relates to the art of electrical connectors and, particularly, to a high-speed edge connector for a printed circuit board.

BACKGROUND OF THE INVENTION

A very popular type of electrical connector for use in high-speed electronic equipment, i.e. involving the transmission of high frequencies, commonly is termed an "edge card" connector. In other words, an edge card connector is provided for receiving a printed circuit board having a mating edge and a plurality of contact pads adjacent the edge. Such edge card connectors have an elongated housing defining an elongated slot for receiving the mating edge of the printed circuit board. A plurality of terminals are spaced along one or both sides of the slot for engaging the contact pads adjacent the mating edge of the board. Most often, the terminals have some form or another of spring contact elements for engagement against the contact pads of the board and, often, the spring contact elements are in one form or another of a cantilevered spring arm.

U.S. Pat. No. 5,203,725, to Brunker et al, dated Apr. 20, 1993, and assigned to the assignee of the present invention, shows a biased edge card connector of the character described above. This patent is directed to various improvements in edge card connectors wherein the deflection of the spring contact elements is controlled, resulting in the ability to design very short spring contact beams.

The present invention is directed to further improvements in edge card connectors, including improved biasing means for biasing the printed circuit board, as well as improved latch means for the printed circuit board.

SUMMARY OF THE INVENTION

An object, therefore, of the invention is to provide a new and improved edge card connector for a printed circuit board having a mating edge and a plurality of contact pads adjacent the edge.

Generally, the edge card connector includes a dielectric housing having a board-receiving slot for receiving the edge of the printed circuit board. A plurality of spring contact elements are mounted in the housing along at least one side of the slot. The spring contact elements have spring contact portions extending into the slot for contacting respective ones of the contact pads on the printed circuit board. The housing includes a surface at one side of the slot defining a datum plane beyond which the spring contact portion of at least one of the spring contact elements extends into the slot. Biasing means is provided in the housing for biasing the printed circuit board against the surface, thereby deflecting the spring contact portion of at least one spring contact element a predetermined amount.

According to one aspect of the invention, the biasing means is provided by a second spring contact portion extending into the slot for contacting the printed circuit board on a side opposite the one side of the board and biasing the one side of the board against the datum plane and the first spring contact portion. The second spring contact portion is generally C-shaped and extends from a base portion of the spring contact portion in a generally uniformly decreasing cross-section from a relatively wide base end at the base portion to a relatively narrow distal end for contacting the printed circuit board.

Specifically, the generally C-shaped second spring contact portion has a generally circular inside edge and a generally circular outside edge formed on a larger radius than the inside edge, and with the centers of curvature of the edges being offset. Preferably the distal end of the generally C-shaped second spring contact portion has an outwardly flared tip to assist in guiding the mating edge of the printed circuit board between the first and second spring contact portions.

According to another aspect of the invention, the spring contact elements include ground contact elements and signal contact elements respectively alternating lengthwise of the board-receiving slot. The spring contact elements have board-mounting feet projecting from the elongated housing generally in a line therealong. The board-mounting feet of the ground contact elements are larger than the board-mounting feet of the signal contact elements to provide shielding for the signal contact elements. As disclosed herein, the board-mounting feet of the spring contact elements comprise right-angled surface-mount solder tails.

Another feature of the invention involves the provision of the base portions of at least some of the spring contact elements with tool-engaging shoulder. The shoulder is adapted for engagement by an appropriate contact insertion tool. In the preferred embodiment, the spring contact elements each include a barb insertable into a mounting hole in the housing. The tool-engaging shoulder is generally aligned with the barb in a contact-insertion direction.

The edge connector also includes a pair of board latches mounted at the opposite ends of the housing and including board-lock means for lockingly engaging opposite sides of the printed circuit board when the board is inserted into the board-receiving slot. It is contemplated that the pair of latches are identical and interchangeable at opposite ends of the housing to reduce manufacturing and inventory expenses.

More particularly, the board latches are mounted to the outside of the opposite ends of the housing, with the board-lock means projecting to the inside of the housing. The board latches are stamped and formed of sheet metal material and include first ends fixed to the housing and free ends resiliently movable relative to the housing. The board lock means are located near the free ends. Anti-overstress means are provided at the free ends to limit the resilient movement of the free ends of the board latches.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
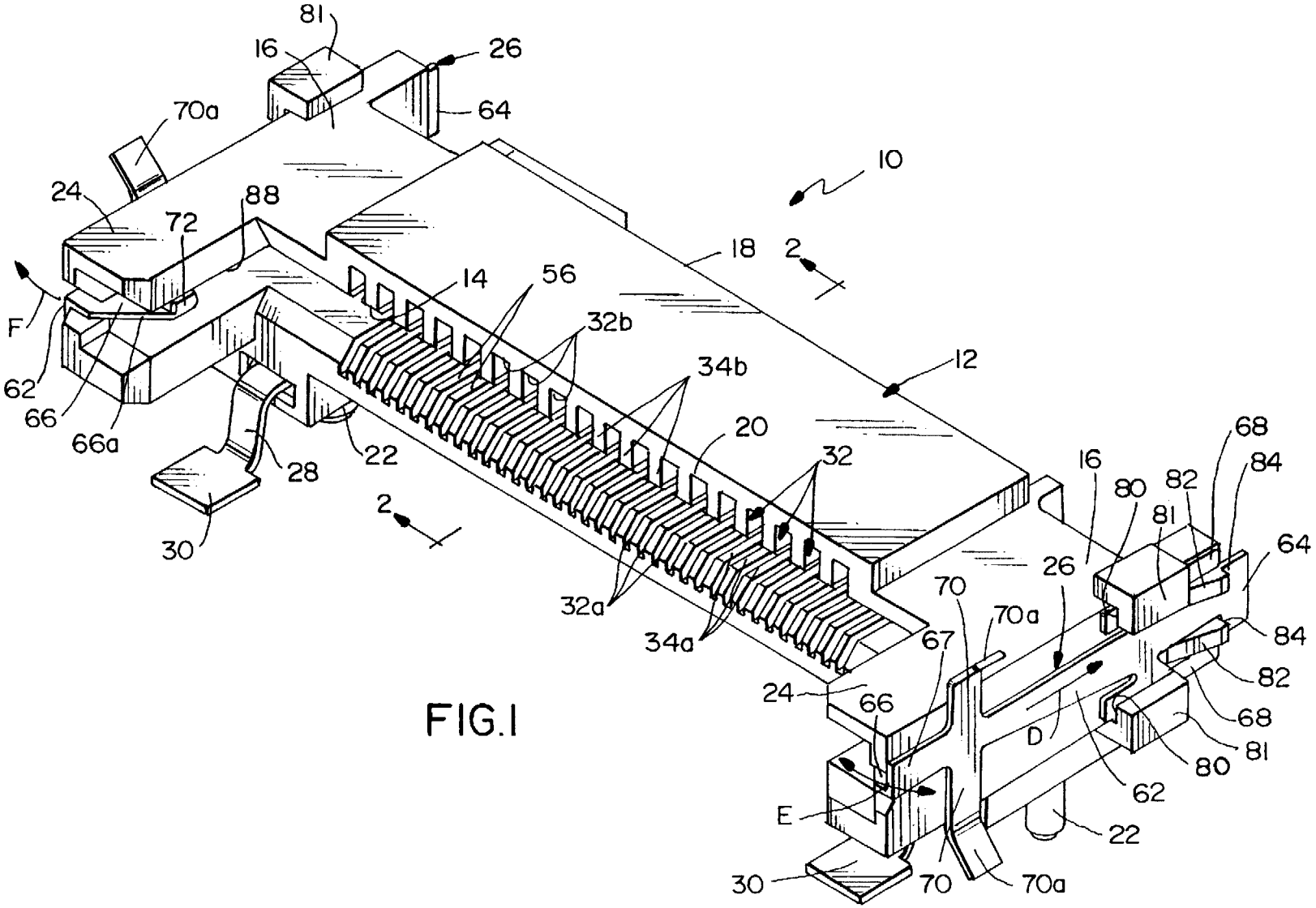
FIG. 1 is a perspective view looking at the card-insertion face of an elongated edge connector embodying the concepts of the invention.

Referring to the drawings in greater detail, and first to FIG. 1, the invention is embodied in an edge connector, generally designated 10, for receiving a printed circuit board 89 having a mating edge 90 and a plurality of contact pads 92, 94 adjacent the edge. These types of connectors commonly are called "edge card" connectors in that they have receptacle means in the form of slots for allowing insertion of an edge of printed circuit boards into contact areas of the connectors. Such connectors are well known in the industry as exemplified by U.S. Pat. No. 5,203,725, assigned to the assignee of this invention. Such connectors are elongated and have rows of spring contact elements spaced along one or both sides of an elongated card-receiving slot extending lengthwise of a dielectric housing. The spring contact elements engage contact pads spaced along a mating edge of the printed circuit board which is inserted into the slot.

With this understanding, edge connector 10 includes a dielectric housing, generally designated 12, having a board-receiving slot 14 running the length of the connector between opposite ends 16 of the housing. The housing, in essence, defines a terminating face 18 and a board-receiving face 20, with slot 14 opening at the board-receiving face. A plurality of mounting pegs 22 depend from housing 12 for insertion into appropriate mounting holes of a second printed circuit board (now shown). In some applications, the second printed circuit board is called a mother board and the printed circuit board which is inserted into slot 14 is called a daughter board. A pair of wings or guides 24 project forwardly of the housing at opposite ends 16 thereof. A board latch, generally designated 26, is mounted on the outside of each wing 24 at each opposite end of the housing. A pair of metal fitting nails or solder tabs 28 are mounted in housing 12 and project forwardly of the board-receiving face and include solder feet 30 for securement to solder pads on the mother board.

Still further, referring to FIG. 2 in conjunction with FIG. 1, housing 12 includes a plurality of transverse cavities, generally designated 32, spaced longitudinally of slot 14 for receiving alternating, differently configured terminals, as described below. Specifically, each cavity 32 has a cavity portion **32*a* on one side of slot 14 (the bottom side as viewed in FIG. 2) and a cavity portion 32*b* on the opposite side of the slot (the top side as viewed in FIG. 2). Cavities 32 are separated lengthwise of the elongated housing by wall means or partitions which include wall portions 34*a* separating cavity portions 32*a* and wall portions 34*b* separating cavity portions 32*b***.

Housing 12 also includes a plurality of recesses or apertures 36 (FIG. 2) outside cavities 32 and generally in transverse alignment therewith, for purposes described hereinafter. Each aperture 36 includes a mouth **36*a* opening at the terminating face 18** of the housing. The entire housing is unitarily molded of dielectric material such as plastic or the like.

Generally, a plurality of terminals are mounted in housing 12, spaced longitudinally of the housing and corresponding to the plurality of transversely aligned cavities 32 and apertures 36. The terminals are located on housing 12 with contact elements alternating lengthwise of the housing for alternatingly engaging the contact pads 92, 94 in the two rows thereof (FIG. 9) along the mating edge 90 of the printed circuit board 89.

Figure 2:
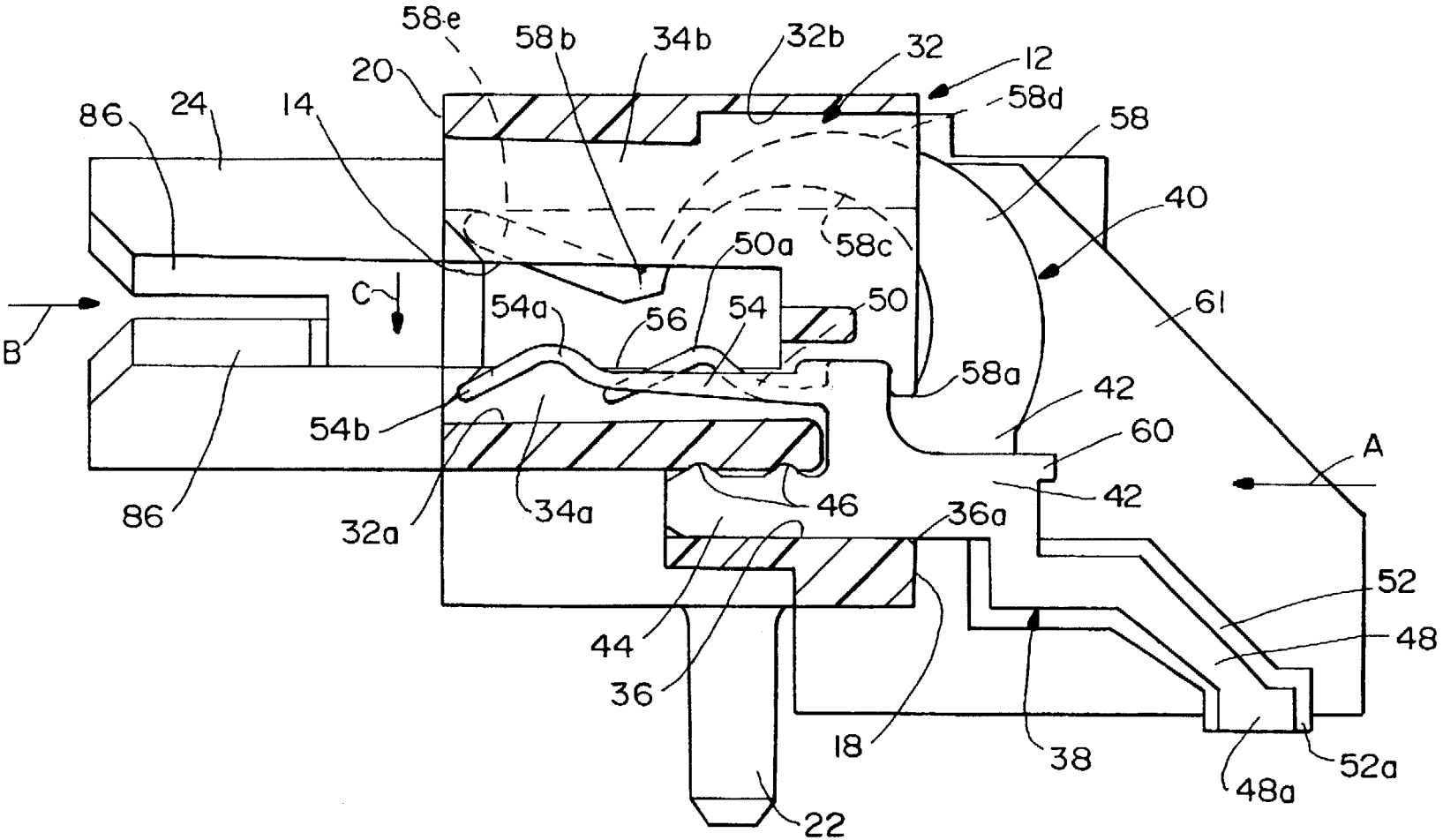
FIG. 2 is a vertical section taken generally along line 2—2 of FIG. 1.

More particularly, as best seen in FIG. 2, terminals, generally designated 38 and 40, are mounted in housing 12 in an alternating array lengthwise of the housing. In other words, terminals 38 alternate between adjacent terminals 40, and vice versa. Terminals 38 are signal terminals within edge connector 10, and terminals 40 are ground/power terminals within the connector. Both configurations of terminals 38 and 40 are similar to the extent that they have base portions 42 and barb portions 44 projecting forwardly from the base portions. The terminals are mounted to housing 12 by inserting barb portions 44 through mouths **36*a* of apertures 36 from terminating face 18 of the housing to create an interference fit between the barbs and the side walls of their respective apertures. If desired, serrations 46 may be formed in one or both edges of barbs 44 to bite into the plastic material of the housing at the side walls of apertures 36**.

Figure 3:
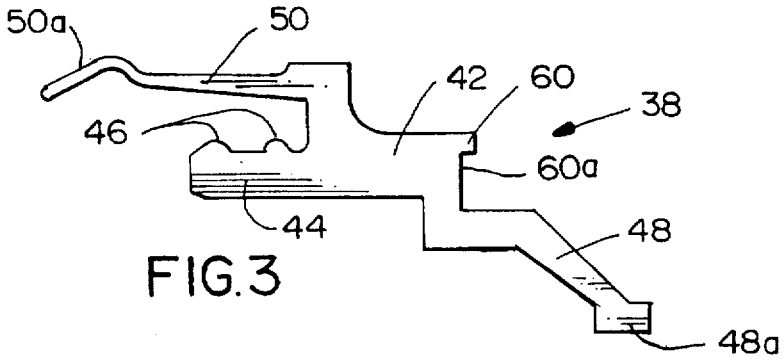
FIG. 3 is an elevational view of one of the signal contact elements.

Referring to FIG. 3 in conjunction with FIG. 2, signal terminals 38 have board-mounting feet 48 in the form of right-angled solder tails extending outwardly and downwardly from the base portions 42 of the terminals. The solder tails terminate in surface mount portions **48*a* for soldering to appropriate signal circuit traces on the mother board. Signal terminals 38 also have cantilevered spring contact elements 50 projecting from their respective base portions 42 into cavity portions 32*a*. Each spring contact element 50 has a contact point 50*a* which projects from cavity portion 32*a* into slot 14**.

Figure 4:
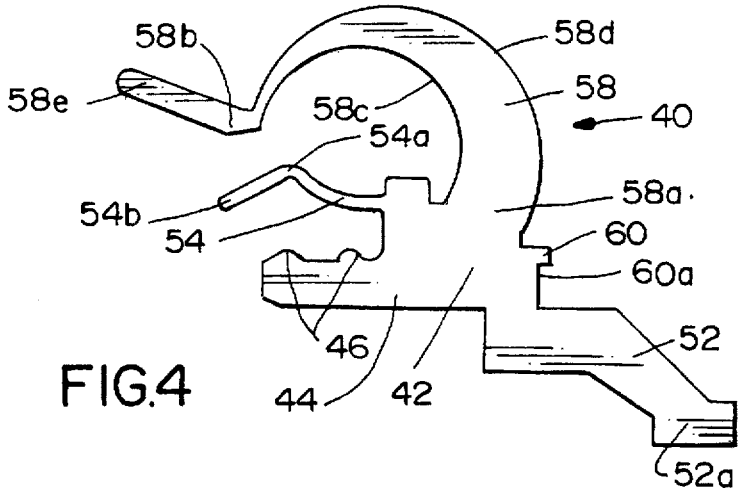
FIG. 4 is an elevational view of one of the ground contact elements.

Referring to FIG. 4 in conjunction with FIG. 2, each ground/power terminal 40 also includes a board-mounting foot 52 in the form of a right-angled solder tail portion projecting outwardly and downwardly from the respective base portion 42 of the terminal. The solder tail terminates in a surface mount portion **52*a* for soldering to an appropriate ground/power circuit trace on the mother board. Each terminal 40 also includes a cantilevered spring contact element 54 projecting from the base portion 42 into a respective one of the cavity portions 32*a* alternating with the cavity portions 32*a* into which the spring contact elements 50 of terminals 38 project. Each spring contact element 54 includes a contact point 54*a* projecting into slot 14. It can also be seen that the beam of spring contact element 54 is generally arcuate in a direction opposite second spring contact portion 58** described below.

It can be seen in FIGS. 2–4 that spring contact element 50 of terminal 38 is longer than spring contract element 54 of terminal 40. Regardless, it can be seen in FIG. 2 that both configurations of spring contact elements 50 and 54 project into slot 14 for engaging the contact pads along the mating edge of the printed circuit board (daughter board) inserted into slot 14 in the direction of arrow "B" (FIG. 2).

Generally, it is contemplated that housing 12 be provided with a surface along the side of slot 14 (the bottom in FIG. 2) from which spring contact elements 50 and 54 project, to define a datum plane beyond which contact points **50*a* and 54*a* project into the slot. In addition, biasing means is provided for biasing the printed circuit board against the surface, thereby deflecting the spring contact elements 50 and 54** a constant and predetermined amount.

More particularly, wall portions 34*a* between cavity portions 32*a* have edges 56 which are in alignment lengthwise of housing 12 and which define one side (the bottom side as viewed in the drawings) of slot 14. These edges combine to define the datum plane beyond which contact points 50*a* and 54*a* of spring contact elements 50 and 54, respectively, project as seen in FIG. 2. Therefore, it can be understood that if the daughter printed circuit board is biased against the datum plane in the direction of arrow "C", the datum plane provides an abutment or stop to prevent further movement of the board and further deflection of the spring contact elements. Once the board engages the datum plane defined by edges 56 of wall portions 34*a*, the spring contact elements cannot be deflected any further. Consequently, the deflection of the spring contact elements is predetermined and constant. Other aspects of this concept can be derived from the aforementioned U.S. Pat. No. 5,203,725.

As generally stated above, biasing means is provided for biasing the daughter printed circuit board against the datum plane defined by edges 56 of wall portions 34*a* and deflecting spring contact elements 50 and 54. More particularly, each ground terminal 40 has a second spring contact portion 58 extending from base portion 42 into a respective one of the cavity portions 32*b* and then downwardly into slot 14. Generally, the second spring contact portion is effective for contacting the daughter printed circuit board on a side thereof opposite the side which engages spring contact elements 50 and 54 and biasing the board against datum plane 56 while deflecting the spring contact elements 50 and 54.

More particularly, as best seen in FIG. 4, each ground terminal 40 is a monolithic structure including spring contact element or portion 54 and second spring contact portion 58. The second spring contact portion is generally C-shaped and extends from base portion 42 in a generally uniformly decreasing cross-section from a relatively wide base end 58*a* at base portion 42 to a relatively narrow distal end 58*b* for contacting the daughter printed circuit board and biasing the board toward datum plane 56. Geometrically, generally C-shaped second spring contact portion 58 has a generally circular inside edge 58*c* and a generally circular outside edge 58*d*. The circular outside edge is formed on a larger radius than the circular inside edge, as can be seen. In addition, the centers of curvature of the edges are offset in order to geometrically circumscribe the wider base end 58*a* and the narrower distal end 58*b* of second spring contact portion 58. Lastly, an outwardly flared tip 58*e* is formed at distal end 58*b*, opposite an opposing outwardly flared tip 54*b* of spring contact element or portion 54, to assist in guiding the mating edge of the printed circuit board between the two spring contact portions.

Referring to FIG. 2, it can be seen that board-mounting foot or solder tail 52 of ground terminal 40 is significantly larger than board-mounting foot or solder tail 48 of signal terminal 38. With the signal and ground terminals alternating lengthwise of housing 12 of connector 10, the larger solder tails of the ground terminals provide effective shielding for the smaller solder tails of the signal terminals.

Another feature of the invention is shown in FIGS. 2–4 wherein it can be seen that each of terminals 38 and 40 are provided with a tab or boss 60 projecting rearwardly of base portion 42 opposite the insertion direction of arrow "A" (FIG. 2). The tabs define a shoulder 60*a* adapted for engagement by an appropriate contact insertion tool. It can be seen that the shoulder is generally aligned with barb 44 in the contact insertion direction of arrow "A". Therefore, the insertion tool will drive barb 44 into its respective aperture 36 in the housing without a tendency to twist or skew the terminal during insertion.

Figure 5A:
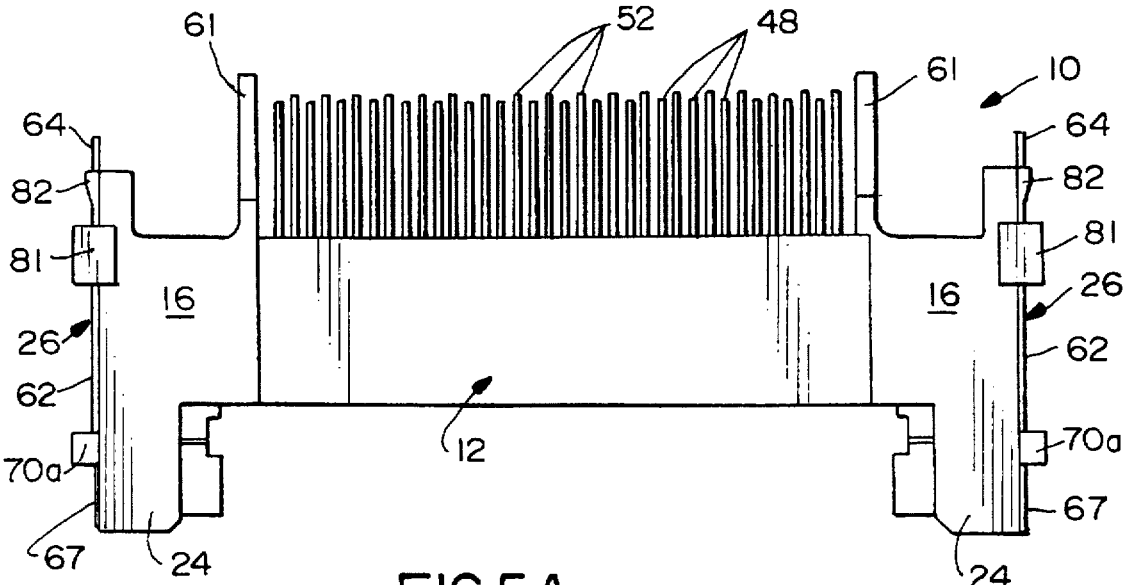
FIG. 5A is a top plan view of the connector.
Figure 5:
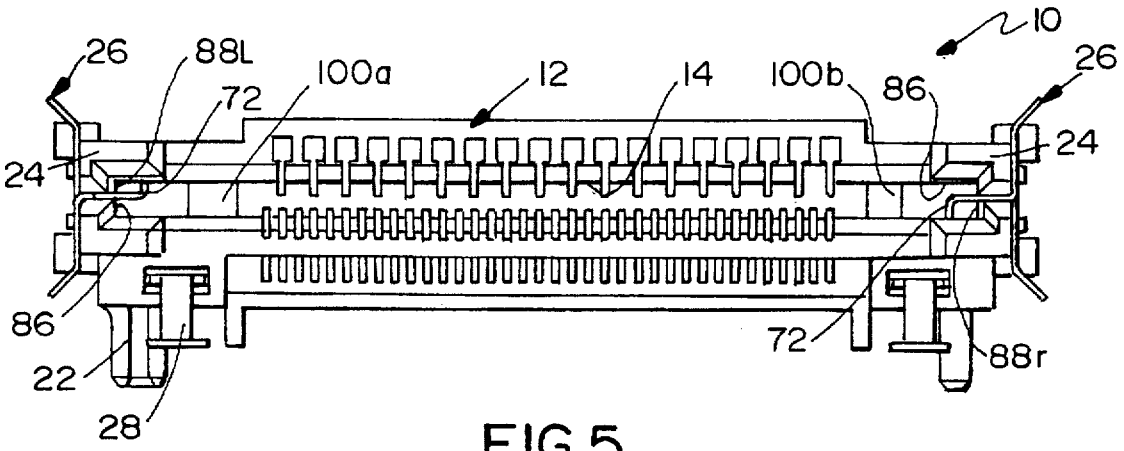
FIG. 5 is a front elevational view of the connector.
Figure 7:
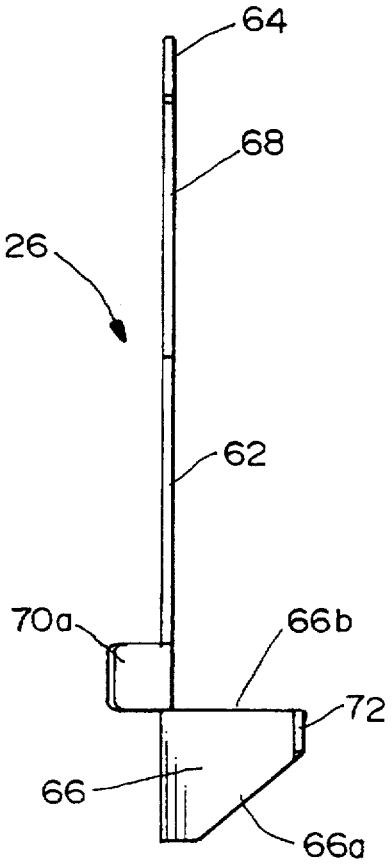
FIG. 7 is an elevational view of one side edge of the board latch.
Figure 6:
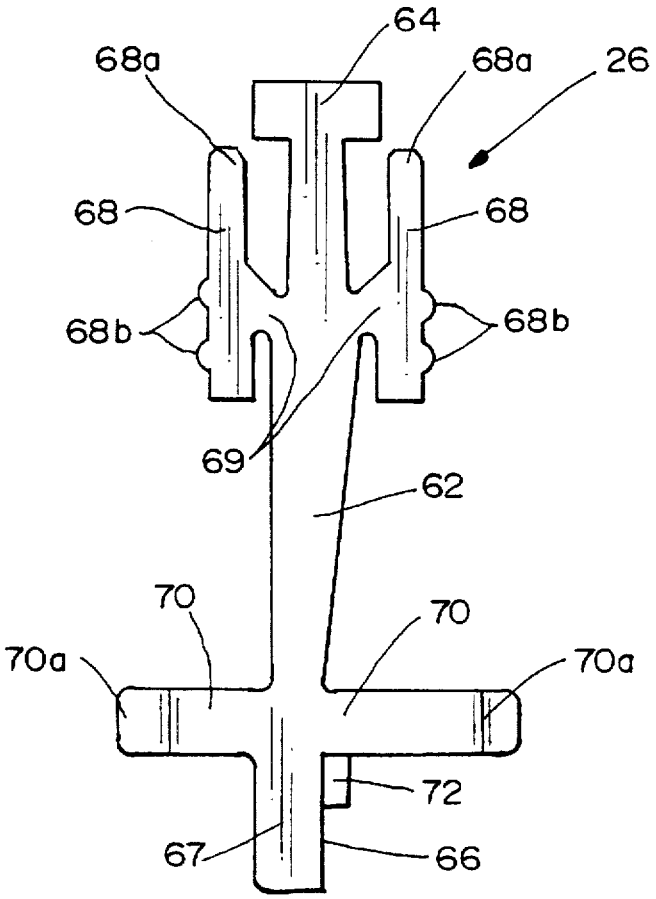
FIG. 6 is a plan view of one of the board latches.

FIGS. 2 and 5 show that housing 12 has a pair of rearwardly extending walls 61 at opposite ends of the array of solder tails 48 and 50. These walls not only stabilize the housing on the mother board, but they protect the solder tails.

Referring to FIGS. 1 and 5–8 in conjunction with FIG. 1, board latches 26 now will be described. The board latches are stamped and formed of sheet metal material. It should be understood that the invention contemplates that a single board latch construction 26 be provided and which can be mounted at either opposite end 16 of connector housing 12 outside either wing 24 thereof, such that the board latches can be considered as "universal" in use with connector 10. Specifically, each universal board latch 26 includes an elongated body 62 having a snap-latch head 64 at one end thereof and a board-lock flange 66 at the opposite or free end 67 of the body. Head 64 is coplanar with the body, and flange 66 projects transversely of or perpendicular to the body. A pair of retaining arms 68 are formed coplanar with, and parallel to but spaced from the body at opposite edges thereof near head 64 and connected to the body by webs 69. The retaining arms 68 includes free ends 68*a* and retention bumps or projections 68*b* described further below.

Figure 8:
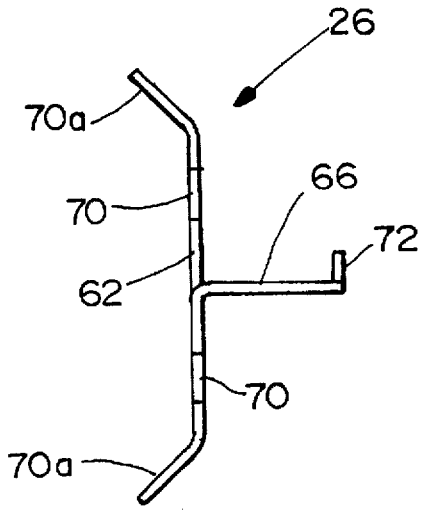
FIG. 8 is an elevational view of one end edge of the board latch.

A pair of operating arms 70 are formed coplanar with the body near board-lock flange 66. The operating arms have distal ends 70*a* that are bent outwardly as best seen in FIGS. 1 and 8 to define finger tabs which facilitate manual deflection of the latches by an operator to permit removal of a circuit board inserted into the connector. Lastly, an anti-overstress tab 72 projects transversely of board-lock flange 66 at an inner end thereof. It can be seen in FIG. 5 that the anti-overstress tab 72 of the left-hand board latch 26 projects upwardly, while the anti-overstress tab 72 of the right-hand board latch projects downwardly. This shows the universal nature of the board-latches.

In mounting board latches 26 onto connector housing 12, reference is made particularly to FIG. 1 and the right-hand end thereof. In assembly, the respective board latch is mounted to the outside of the end of the housing in the direction of arrow "D." During this assembly action, retaining arms 68 slide into recesses 80 formed beneath mounting shoulders 81 formed on the housing. As snap-latch head 64 rides up ramps 82 on the housing, the free ends 68*a* of retaining arms 68 are within recesses 80 to prevent the remaining portion of latches 26 from moving up ramp 82 with snap-latch head 64. In other words, free ends 68*a* enter recesses 80 before the snap-latch-head 64 begins moving up ramp 82. Further insertion of the latches causes the snap-latch head to snap back downwardly behind locking shoulders 84 at the ends of the ramps. In addition, retention projections 68*b* engage the housing within recesses 80. The board latch now is fully mounted and cannot move back opposite the direction of arrow "D," because head 64 is locked behind shoulders 84. The head end of the board latch cannot move away from the housing because retaining arms 68 are captured behind shoulders 80 of the housing. This leaves the opposite end of the board latch to move freely away from the housing and back against the housing in the direction of double-headed arrow "E."

When the daughter board is inserted into slot 14 of connector housing 12, the corners 90*a*, 90*b* (FIG. 9) of the board (at the ends of its mating edge) engage a chamfered or angled edge 66*a* (FIG. 7) of board-lock flanges 66. This biases the free ends of the board latches 26 outwardly in the direction of arrow "F" (FIG. 1). The board is provided with locking notches 96 in its opposite side edges and which define locking shoulders 96a which align with locking edges 66b (FIG. 7) of board latches 26, which snap back opposite the direction of arrow "F" into locking engagement with the notches in the board.

When an operator decides to remove the daughter board from connector 12, one or both board latches 26 are deflected outwardly in the direction of arrow "F" (FIG. 1) by manually pressing on outwardly flared finger tabs 70a of operating arms 70. Edges 66b (FIG. 7) of board-lock flanges 66 will clear the notches in the sides of the board and allow the board to be pulled out of slot 14. Anti-overstress tabs 72 will fit within a notch 88 formed in the insides of wings 24 permit the flange 66 to move completely outside the card slot 14. As viewed in FIG. 5, the left-hand notch 88L is formed in the upper portion of surface 86 within left wing 24 and the right-hand notch 88R is formed in the lower portion of surface 86 within right wing 24. In fact, the anti-overstress tabs 72 engage the notches 88L, 88R to prevent the operator from pulling the free ends of the board latches too far outwardly which might overstress the latches in that they are stamped and formed of sheet metal material.

Figure 9:
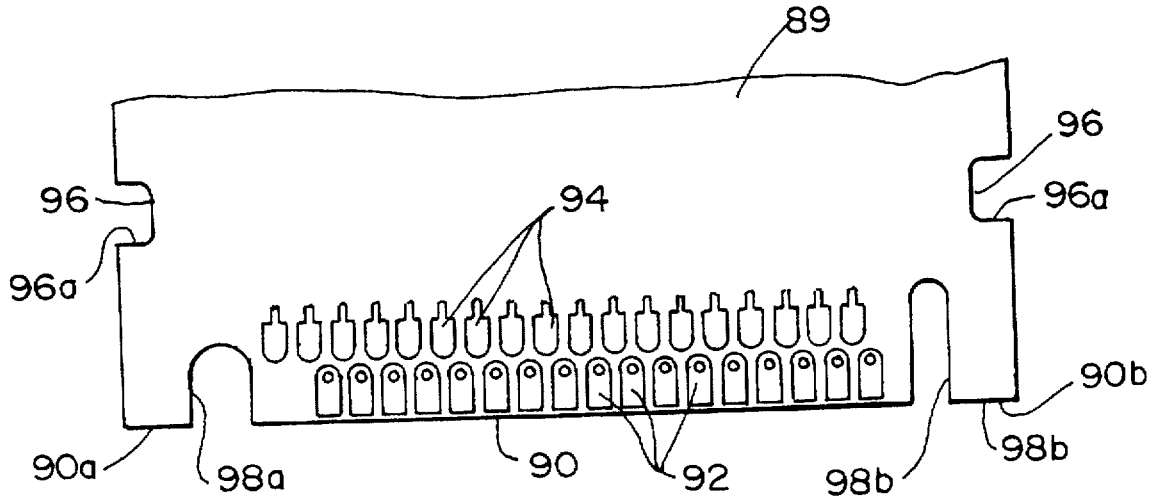
FIG. 9 is a fragmented plan view of the mating end of a printed circuit board insertable into the connector of FIG. 1.

Lastly, referring to FIG. 9, the mating end of a printed circuit board 89 having a mating edge 90 for insertion into board-receiving slot 14 of connector housing 12, is illustrated. The board has one row of contact pads 92 along edge 90 for engagement by contact points 54a of spring contact elements 54 of ground terminals 40. The board has a second row of contact pads 94 spaced inwardly of edge 90 for engagement by contact points 50a of spring contact elements 50 of signal terminals 38. Notches 96 can be seen formed in the side edges of the board for engagement therewithin by locking edges 66b (FIG. 7) of board-lock flanges 66 of board latches 26. The board also has a pair of differently sized and/or shaped polarizing notches 98a and 98b formed in edge 90 near the opposite ends thereof. These polarizing notches 98a and 98b embrace polarizing projections or bosses 100a and 100b, respectively, shown in FIG. 5 within board-receiving slot 14. The polarizing notches and bosses effectively polarize the printed circuit board lengthwise of the elongated connector housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An edge connector for receiving a printed circuit board having a mating edge and a plurality of contact pads adjacent the edge, said connector comprising: an elongated dielectric housing having a board-receiving slot for receiving the mating edge of the printed circuit board, and a plurality of one-piece ground/power contact elements and a plurality of signal contact elements, said ground/power contact elements and said signal contact elements being mounted in the housing along at least one side of the slot and alternating lengthwise along said slot, said plurality of ground/power contact elements having first and second spring arms, said first spring arm having a contact portion extending into the slot for contacting a respective one of the contact pads on one side of the printed circuit board, each of said plurality of signal contact elements having a spring arm with a contact portion extending into the slot for contacting a different respective one of said contact pads on said one side of the printed circuit board, a surface on the housing at said one side of the slot defining a datum plane beyond which the contact portion of the first spring arm extends into the slot, said second spring arm having a contact portion extending into said slot for contacting the printed circuit board on a side opposite said one side of the board and biasing said one side of the board against said datum plane and said contact portions of said first spring arms, the first and second spring arms projecting from a base portion of said ground/power contact elements, said ground/power and said signal contact elements having board-mounting feet projecting beyond the elongated housing generally in a line therealong, each said second spring arm being generally C-shaped and extending from the base portion in a generally uniformly decreasing cross-section from a relatively wide base end at the base portion to a relatively narrow distal end, said contact portion of said second spring arm being positioned generally adjacent said relatively narrow distal end of said generally C-shaped second spring arm for contacting the printed circuit board.

2. An edge connector as set forth in claim 1, wherein said generally C-shaped second spring arm has a generally circular inside edge and a generally circular outside edge formed on a larger radius than the inside edge, and with the centers of curvature of the edges being offset.

3. An edge connector as set forth in claim 1, wherein the distal end of said generally C-shaped second spring arm has an outwardly flared tip to assist in guiding the mating edge of the printed circuit board between contact portions of the first and second spring arms.

4. An edge connector as set forth in claim 1, wherein said board-mounting feet of the contact elements comprise right-angled surface-mount solder tails.

5. An edge connector as set forth in claim 1, wherein the base portions of at least some of the contact elements include a tool-engaging shoulder adapted for engagement by an appropriate contact insertion tool.

6. An edge connector as set forth in claim 5, wherein the contact elements include a barb insertable into a mounting recess in the housing, and said tool-engaging shoulder is generally aligned with the barb in a contact-insertion direction.

7. An edge connector as set forth in claim 1 wherein said centers of curvature are substantially offset from each other.

8. An edge connector for receiving a printed circuit board having a mating edge and a plurality of contact pads adjacent the edge, said connector comprising:

an elongated dielectric housing having a board-receiving slot for receiving the mating edge of the printed circuit board and a surface on the housing at one side of the slot defining a datum plane;

a plurality of one-piece conductive ground/power terminals mounted in the housing along said slot, each of said plurality of one-piece ground/power terminals having first and second spring arms projecting from a base portion and a board-mounting foot projecting beyond said housing, said first spring arm having a contact portion extending into the slot for contacting a respective one of the contact pads on said one side of the printed circuit board, the contact portion of the first spring arm extending past said datum plane into the slot, said second spring arm having a contact portion extending into said slot for contacting the printed circuit board on a side opposite said one side of the board and biasing said one side of the board against said datum plane and said contact portions of said first spring arms, said second spring arm being generally C-shaped and extending from the base portion in a generally uniformly decreasing cross-section from a relatively wide base end at the base portion to a relatively narrow distal end, said contact portion of said second spring arm being positioned generally adjacent said relatively narrow distal end of said generally C-shaped second spring arm for contacting the printed circuit board and said generally C-shaped second spring arm has a generally circular inside edge and a generally circular outside edge formed on a larger radius than the inside edge, and with the centers of curvature of the edges being substantially offset; and a plurality of conductive signal terminals mounted in the housing along said slot, each of said plurality of signal terminals having a spring arm projecting from a base portion and a board-mounting foot projecting beyond said housing;

each of said ground/power terminals having a signal terminal adjacent said ground/power terminal on opposite sides thereof along said slot and said board-mounting feet of said ground/power and signal terminals being positioned generally in line along said housing.

9. An edge connector as set forth in claim 8, wherein the distal end of said generally C-shaped second spring arm has an outwardly flared tip to assist in guiding the mating edge of the printed circuit board between contact portions of the first and second spring arms.

10. An edge connector as set forth in claim 8, wherein said board-mounting feet of the terminals comprise right-angled surface-mount solder tails.

11. An edge connector as set forth in claim 8, wherein the base portions of at least some of the terminals include a barb insertable into a mounting recess in the housing and a tool-engaging shoulder adapted for engagement by an appropriate terminal insertion tool, said tool-engaging shoulder being generally aligned with the barb in a terminal-insertion direction.

12. An edge connector for receiving a printed circuit board having a mating edge and a plurality of contact pads adjacent the edge, said connector comprising:

an elongated dielectric housing having a board-receiving slot for receiving the mating edge of the printed circuit board and a surface on the housing at one side of the slot defining a datum plane;

a plurality of one-piece first conductive terminals mounted in the housing along said slot, each of said plurality of one-piece first terminals having first and second spring arms projecting from a base portion and a board mounting foot projecting beyond the housing, said first spring arm having a contact portion extending into the slot for contacting a respective one of the contact pads on said one side of the printed circuit board, the contact portion of the first spring arm extending past said datum plane into the slot, said second spring arm having a contact portion extending into said slot for contacting the printed circuit board on a side opposite said one side of the board and biasing said one side of the board against said datum plane and said contact portions of said first spring arms, said second spring arm being generally C-shaped and extending from the base portion in a generally uniformly decreasing cross-section from a relatively wide base end at the base portion to a relatively narrow distal end, said contact portion of said second spring arm being positioned generally adjacent said relatively narrow distal end of said generally C-shaped second spring arm for contacting the printed circuit board; and a plurality of second conductive terminals mounted in the housing along said slot, each of said plurality of terminals having a spring arm projecting from a base portion and a board mounting foot projecting beyond the housing;

each of said first terminals having one of said second terminals adjacent said first terminal on opposite sides thereof along said slot and said board-mounting feet of said first and second terminals being positioned generally in line along said housing, one of said first and second terminals being a ground/power terminal and the other of said first and second terminals being a signal terminal.

* * * * *